US008600261B2

(12) United States Patent
Han

(10) Patent No.: US 8,600,261 B2
(45) Date of Patent: Dec. 3, 2013

(54) DEVELOPING UNIT AND IMAGE FORMING APPARATUS HAVING THE SAME

(75) Inventor: Min Su Han, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 832 days.

(21) Appl. No.: 12/632,205

(22) Filed: Dec. 7, 2009

(65) Prior Publication Data

US 2010/0158574 A1 Jun. 24, 2010

(30) Foreign Application Priority Data

Dec. 19, 2008 (KR) ..... 10-2008-0130473

(51) Int. Cl.
*G03G 15/08* (2006.01)

(52) U.S. Cl.
USPC ..... 399/103; 399/105

(58) Field of Classification Search
USPC ..... 399/102, 103, 105, 106, 110, 119, 120, 399/258, 260
See application file for complete search history.

(56) References Cited

U.S. PATENT DOCUMENTS

| | | | | |
|---|---|---|---|---|
| 5,839,028 | A | 11/1998 | Nomura et al. | |
| 2005/0191084 | A1* | 9/2005 | Murakami | 399/103 |
| 2009/0154952 | A1 | 6/2009 | Ito et al. | |

FOREIGN PATENT DOCUMENTS

| | | |
|---|---|---|
| EP | 0 634 707 | 1/1995 |
| JP | 11-327304 | 11/1999 |
| JP | 2001-142289 | 5/2001 |
| JP | 2002-328527 | 11/2002 |
| JP | 2002-372862 | 12/2002 |
| JP | 2002372862 | 12/2002 |
| KR | 10-2008-0054172 | 6/2008 |

OTHER PUBLICATIONS

English language abstract of KR 10-2008-0054172, published Jun. 17, 2008.
English language abstract of JP 2002-328527, published Nov. 15, 2002.
Machine English language translation of JP 2002-328527, published Nov. 15, 2002.
English language abstract of JP 2001-142289, published May 25, 2001.
Machine English language translation of JP 2001-142289, published May 25, 2001.
English language abstract of JP 11-327304, published Nov. 26, 1999.
Machine English language translation of JP 11-327304, published Nov. 26, 1999.
European office Action Issued on Apr. 11, 2012 in EP Patent Application No. 09177710.2.

(Continued)

*Primary Examiner* — Walter L Lindsay, Jr.
*Assistant Examiner* — Jessica L Eley
(74) *Attorney, Agent, or Firm* — Stanzione & Kim, LLP

(57) ABSTRACT

Disclosed are a developing unit and an image forming apparatus having the same. The developing unit includes a partition frame provided separately from the housing of the developing unit. The partition frame is supported within the housing of the developing unit in such a manner to define a path of movement of developer within the housing through an opening formed in the partition frame. A removable sealing member is detachably arranged on the partition frame to prevent developer leakage during storage or transporting of the developing unit. The installation of the removable sealing member is made easier by the partition frame provided separately from the housing.

12 Claims, 7 Drawing Sheets

(56) References Cited

OTHER PUBLICATIONS

European Search Report issued in EP 09177710.2, mailed Mar. 31, 2010.

English language abstract of JP 2002-372862, published Dec. 26, 2002.

Machine English language translation of JP 2002-372862, published Dec. 26, 2002.

* cited by examiner

DEVELOPING UNIT AND IMAGE FORMING APPARATUS HAVING THE SAME

CROSS-REFERENCE TO RELATED APPLICATION

This application claims the benefit of Korean Patent Application No. 2008-0130473, filed on Dec. 19, 2008 in the Korean Intellectual Property Office, the disclosure of which is incorporated herein by reference.

TECHNICAL FIELD

The present disclosure relate to a developing unit having a removable sealing member for preventing leakage of developer during storage and/or transport of the developing unit and an image forming apparatus having the same.

BACKGROUND OF RELATED ART

Image forming apparatuses are devised to form an image on a printing medium, e.g., sheets of paper, according to input image signals. Examples of image forming apparatuses include printers, copiers, facsimiles, and so-called multi-functional devices that combine some of the functionalities of the aforementioned devices.

Such an image forming apparatus generally includes, e.g., a body defining the overall external appearance of the apparatus, a printing medium supply unit in which sheets of printing media are stored, a developing unit for forming a developer image on a printing medium supplied from the printing medium supply unit, a fusing unit for fusing the developer image to the printing medium and a discharge unit for discharging the printing medium bearing the fused image to the outside of the body.

With the above-described configuration, after the formation of an electrostatic latent image on the surface of a photosensitive body by irradiating light on the charged surface of the photosensitive body of the developing unit, developer is fed to the electrostatic latent image formed on the photosensitive body, to thereby develop the electrostatic latent image into a visible image. Subsequently, the visible image formed on the photosensitive body is transferred to the printing medium supplied from the printing medium supply unit. As the printing medium passes through the fusing unit, the image transferred to the printing medium is fused to the printing medium, thus completing the image formation on the printing medium. The printing medium, on which the image is formed as described above, is discharged to the outside of the body by a discharge unit of the image forming apparatus.

The developing unit may itself include a housing that defines the overall external appearance of the developing unit, and a number of components accommodated in the housing. Such components may include the above-mentioned photosensitive body and a developing body for supplying the developer to the photosensitive body so as to form the visible developer image on the photosensitive body. The housing includes a first frame that defines a developer storage compartment for storing developer therein and a developing compartment in which the above mentioned components, e.g., the photosensitive body and developing body may be received. The housing may also include another frame defining a waste toner storage compartment for storing therein waste toner.

In a developing unit of the above-described configuration, the first frame further defines a partition between the developer storage compartment and the developing compartment. The partition has a developer supply opening through which the developer from the developer storage compartment is supplied into the developing compartment. In order to prevent the developer stored in the developer storage compartment from leaking through a gap between the photosensitive body and the first frame during storage and/or transporting of the developing unit, the developing unit is provided with a removal member is detachably attached to cover and thus to close the developer supply opening . At the time when it is desired to put the developing unit into use, the removal member is detached to open the developer supply opening, thus allowing the developer to be supplied to the photosensitive body.

Unfortunately, the installation of the removal member during the manufacture of the developing unit is difficult to accomplish because the access to the developer supply opening in the first frame of the developing unit may be obstructed at least partially by the various components arranged in the developing compartment or in some cases by the developing compartment itself. Thus, a configuration of developing unit that allows a simpler installation of the removal member is desirable.

SUMMARY OF DISCLOSURE

In accordance with one aspect of the present disclosure, a developing unit may include a first frame, a developing body, a supply member, a partition frame and a removal member. The first frame may define a volume in which developer is received. The developing body may be arranged in the first frame, and may be configured to form an image using the developer. The supply member may be arranged in the first frame in proximity to the developing body so as to supply the developer to the developing body. The partition frame may be provided separately from the first frame, and may be installed to the first frame between the developing body and the supply member. The partition frame may have a developer supply opening through which the developer is supplied to the developing body by the supply member. The removal member may be detachably attached to the partition frame in such a manner to cover at least a part of the developer supply opening.

The first frame may include a lower frame and an upper frame coupled to an upper portion of the lower frame. The lower and upper frames together may define the volume. The partition frame may be arranged between the lower frame and the upper frame.

The partition frame may be fixedly coupled to the lower frame and the upper frame.

The partition frame may include coupling protrusions that are received into recesses correspondingly arranged on the lower frame and the upper frame.

The lower frame and the upper frame may respectively have a first supporting groove and a second supporting groove positioned to oppose each other. The lower and upper ends of the partition frame may respectively be received into, and thereby supported by, the first and second supporting grooves.

The developing unit may further comprise one or more elastic members made of elastically deformable material arranged in at least one of the first supporting groove and the second supporting groove.

The first frame may have formed in opposing sides thereof third supporting grooves. The side ends of the partition frame may be received into, and thereby supported by, the third supporting grooves.

Each of the side ends of the partition frame may include a stepped surface in contact with a correspondingly shaped stepped surface of respective corresponding one of the third supporting grooves.

The developing unit may further comprise a supporting portion extending from the upper end of the partition frame so as to be in contact with, and to thereby be supported by, a portion of the upper frame adjacent the second supporting groove.

The developing unit may further comprise a second frame and a connecting bracket. The second frame may define a storage volume into which waste developer is to be received. The connecting bracket may be configured to couple together the first frame and the second frame. The connecting bracket may have a hole providing an access to the removal member for removal of the removal member.

The first frame may comprise a developing part in which the developing body is arranged. The developing part and the volume may be integrally defined in the lower frame. The partition frame may separate the developing part from the volume.

According to another aspect of the present disclosure, an image forming apparatus may be provided to include a main body and a developing unit received in the main body. The developing unit may include a first frame, a developing body, a supply member, a partition frame and a removal member. The first frame may define a volume in which developer is received. The developing body may be arranged in the first frame, and may be configured to form an image using the developer. The supply member may be arranged in the first frame in proximity to the developing body so as to supply the developer to the developing body. The partition frame may be provided separately from the first frame, and may be installed to the first frame between the developing body and the supply member. The partition frame may have a developer supply opening through which the developer is supplied to the developing body by the supply member. The removal member may be detachably attached to the partition frame in such a manner to cover at least a part of the developer supply opening.

According to yet another aspect of the present disclosure, an apparatus for forming a developer image may be provided to include a housing, a partition frame and a removable sealing member. The partition frame may be formed as a separate member from the housing. The partition frame may have an opening, and may be arranged in the housing in such a manner allowing developer to move from a first location in the housing to a second location in the housing through the opening of the partition frame. The removable sealing member may be arranged to cover the opening of the partition frame. At least a portion of the removable sealing member may be accessible from outside of the housing.

The housing may have a plurality of grooves formed on inner surface thereof, into which grooves peripheral portions of the partition frame may be received.

BRIEF DESCRIPTION OF THE DRAWINGS

Various features and advantages of the present disclosure will become apparent and more readily appreciated from the following description of several embodiments thereof, taken in conjunction with the accompanying drawings, of which.

DETAILED DESCRIPTION OF SEVERAL EMBODIMENTS

Figure 1:
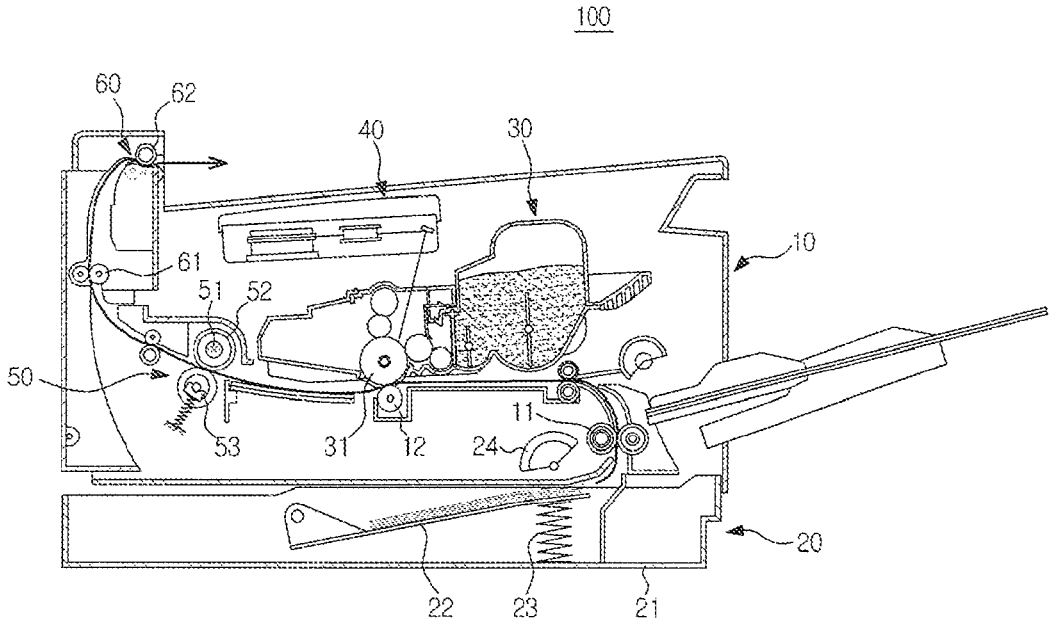
FIG. 1 is a sectional view illustrating a schematic configuration of an image forming apparatus according to an embodiment of the present disclosure.

Reference will now be made in detail to several embodiments of the present disclosure, examples of which are illustrated in the accompanying drawings, wherein like reference numerals refer to the like elements throughout.

As shown in FIG. 1, an image forming apparatus 100 according to an embodiment of the present disclosure may include a body 10 defining the external overall appearance of the apparatus 100, a printing medium supply unit 20 in which printing media P to be used in the image forming apparatus 100 is stored, a developing unit 30 for forming a visible developer image on a printing medium P supplied from the printing medium supply unit 20, an exposure unit 40 for forming an electrostatic latent image on a photosensitive body 31 of the developing unit 30, a fusing unit 50 for fusing the developer image onto the printing medium P, and a discharge unit 60 for discharging the printing medium P, on which a complete image is formed and fused, to the outside of the body 10.

The printing medium supply unit 20 supplies the printing medium P to the developing unit 30, and to that end, may include a printing medium cassette 21, which may be of a drawer type that is removable at least partially from the body 10, and a knock-up plate 22 arranged in the printing medium cassette 21, on which the printing media P is stacked, and a pickup roller 24 for picking up a printing medium P from the knock-up plate 22 sheet by sheet. Feed rollers 11 may be installed in the body 10, and may feed the printing medium P picked up by the pickup roller 24 in the direction of the developing unit 30. The knock-up plate 22 may have one end thereof rotatably arranged in the printing medium cassette 21 while the other end may be elastically supported by an elastic member 23, and may thus be elastically biased to rotate toward the direction of the pickup roller 24.

The exposure unit 40 may be arranged so as to irradiate light containing the image information on the photosensitive body 31, to thereby form an electrostatic latent image on the photosensitive body 31.

The fusing unit 50 may applies heat and pressure to the printing medium P to which the visible image has been transferred so that the image becomes fused onto the printing medium P. To that end, the fusing unit 50 may include a heating roller 52, in which a heater 51 may be received, and a press roller 53 arranged to press the printing medium P against the heating roller 52. As the printing medium P receives heat and pressure while passing between the heating roller 52 and the press roller 53, the developer image becomes fused to the printing medium P.

The discharge unit 60 may include a first discharge roller 61 and a second discharge roller 62 installed in sequence, which may operate to discharge the printing medium P that has passed through the fusing unit 50 to the outside of the body 10.

Figure 2:
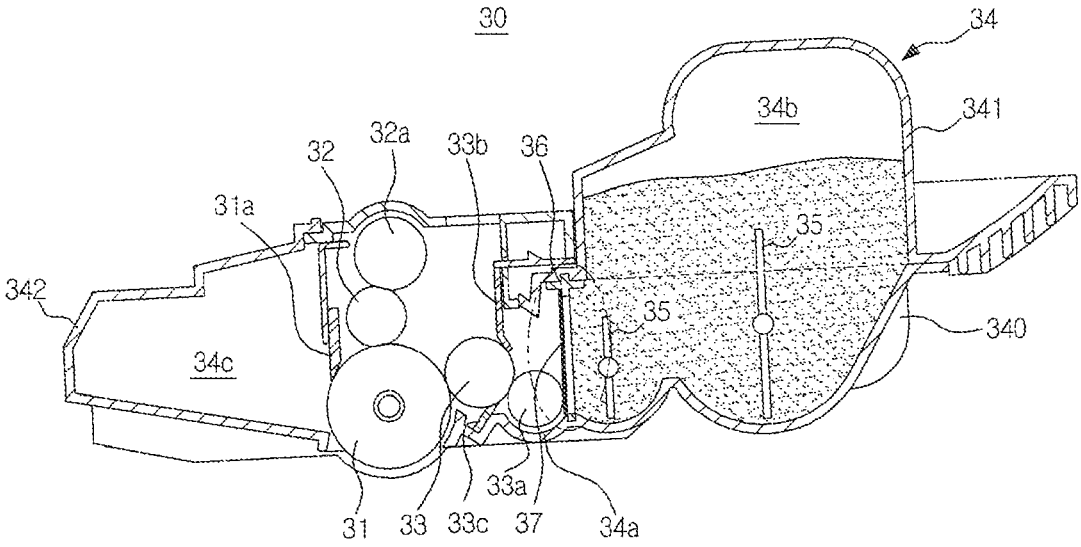
FIG. 2 is a sectional view illustrating a developing unit according to an embodiment of the present disclosure.

The developing unit 30 forms an image using developer on the printing medium P supplied from the printing medium supply unit 20. The developing unit 30 according to an embodiment, as shown in FIG. 2, may include a photosensitive body 31 serving as an image carrier, on the surface of which an electrostatic latent image is formed by the exposure unit 40, a charging roller 32 for charging the photosensitive body 31 to an electrical potential, a developing body 33 for supplying developer to the photosensitive body 31 so as to develop the electrostatic latent image formed on the photosensitive body 31 into a visible developer image, a supply member 33*a* serving as a developer supplier to supply the developer to the developing body 33, a cleaning roller 32*a* for cleaning the charging roller 32 and a housing 34 defining the external overall appearance of the developing unit 30, and supporting therein one or more of the above-mentioned developing body 33, photosensitive body 31, supply member 33*a*, cleaning roller 32*a*, etc. A transfer roller 12 (see FIG. 1) may be provided in the body 10, and may serve to press the printing medium P toward the photosensitive body 31, so as to transfer the developer image formed on the photosensitive body 31 to the printing medium P. Although the supply member 33*a* is of a roller type is shown in FIG. 2 as an illustrative example, other types including, for example, a doctor blade type, a brush type, or a rotating shaft type may alternatively be employed. Further, in some alternative embodiments, the supply member 33*a* may not be necessary, and thus may be omitted.

The housing 34 of the developing unit 30 may include a developing part 34*a*, in which the photosensitive body 31, developing body 33 and supply member 33*a* may be arranged, a developer storage part 34*b*, in which developer is stored, and a waste developer storage part 34*c*, in which waste developer collected from the photosensitive body 31 is stored. According to an embodiment, there may be further provided, in the housing 34 of the developing unit 30, agitators 35 arranged in the developer storage part 34*b* for agitating and for supplying the developer toward the developing body 33, a regulating member 33*b* for regulating the thickness of the developer carried on the developing body 33 to be substantially constant, a cleaning blade 31*a* serving to remove the developer remaining residual on the photosensitive body 31 and to store the removed developer in the waste developer storage part 34*c*, and a sealing member 33*c* having one end thereof installed on the developing part 34*a* and the other end supported on the developing body 33 to thereby serve to prevent the developer from leaking through a gap between the developing body 33 and the housing 34.

Figure 3:
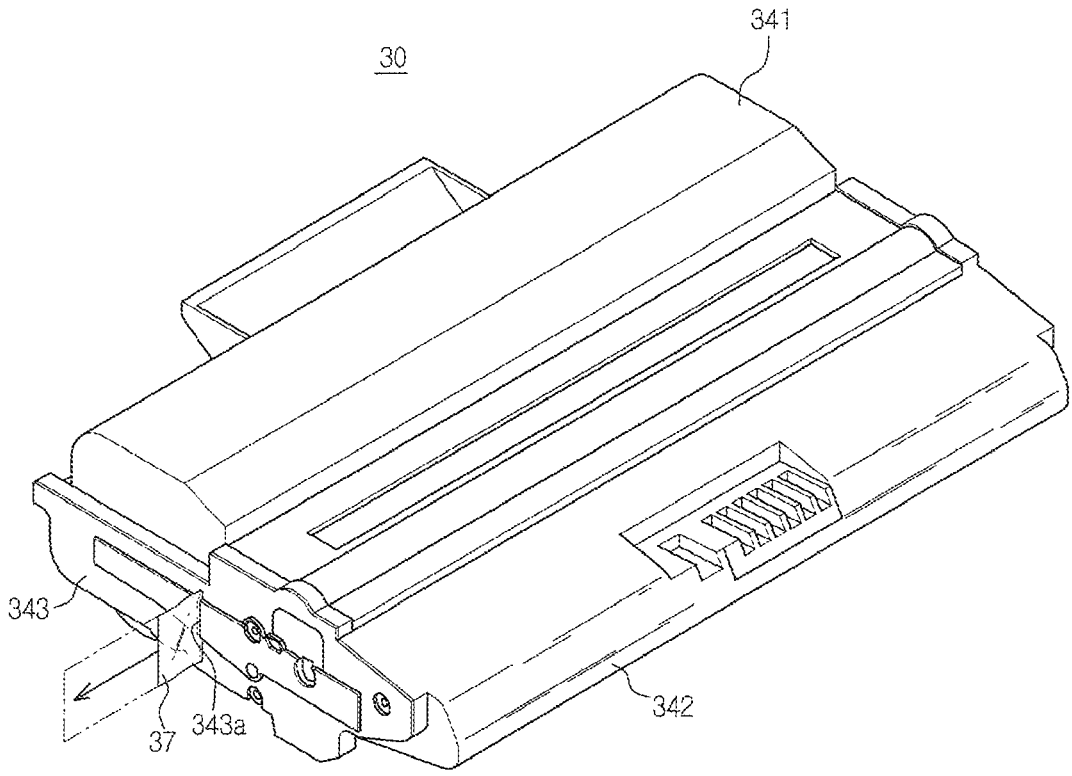
FIG. 3 is a perspective view of a developing unit according to an embodiment of the present disclosure.
Figure 4:
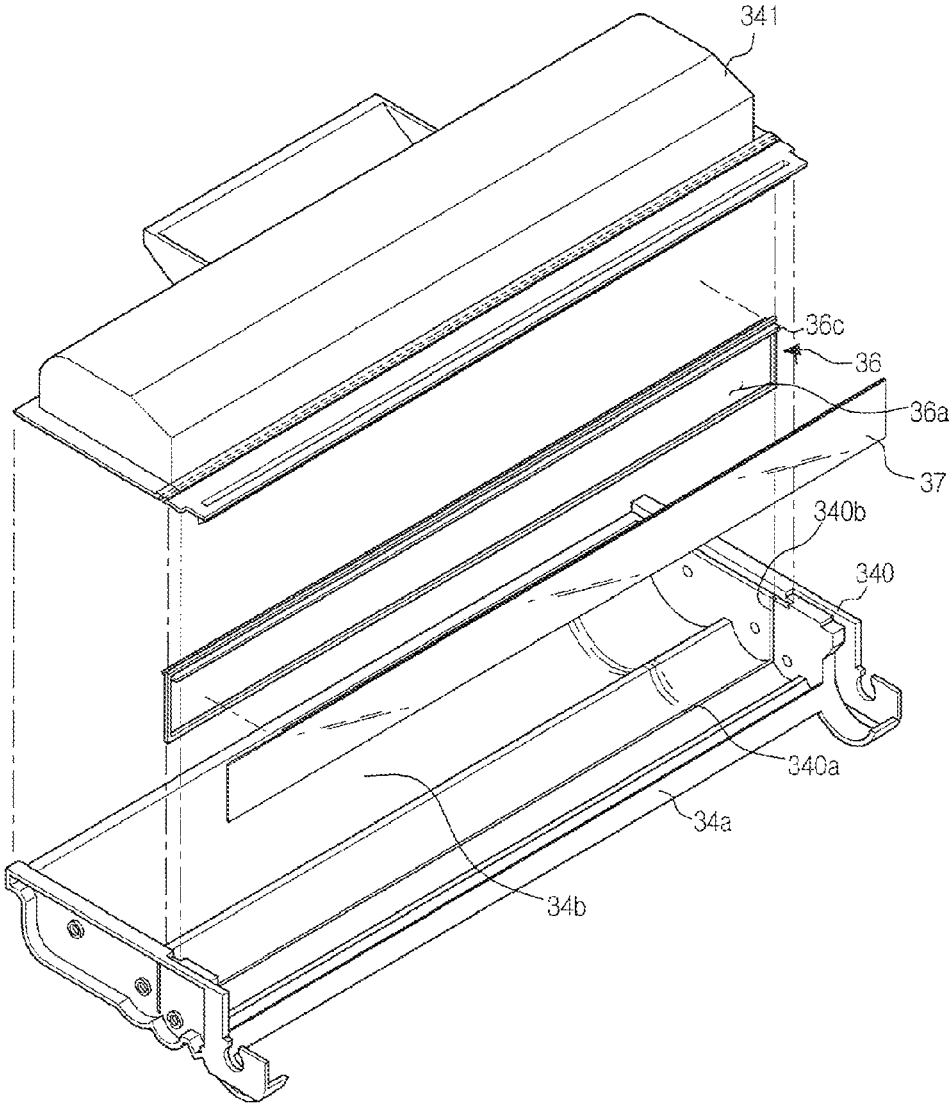
FIGS. 4 and 5 are exploded perspective views illustrating an installation configuration of a partition frame and a removal member of a developing unit according to an embodiment of the present disclosure.

The housing 34 according to an embodiment, as shown in FIGS. 3 and 4, may include the first frames 340 and 341, in which the developing part 34*a* and developer storage part 34*b* are defined parallel to each other, and a second frame 342, in which the waste developer storage part 34*c* (see FIG. 2) is defined. The housing 34 may further include connecting brackets 343 coupled respectively to the side ends of the first frames 340 and 341 and of the second frame 342, thereby coupling together the first frames 340 and 341, and the second frame 342. The first frames 340 and 341 as shown in FIG. 4 may respectively be a lower frame 340 and an upper frame 341 coupled one above the other. According to an embodiment, both the developing part 34*a* and developer storage part 34*b* may be defined in the lower frame 340 parallel to each other. The upper frame 341 may be installed atop the lower frame 340, thus closing the top of the developer storage part 34*b*.

According to an embodiment of the present disclosure, a partition frame 36 may be arranged in the developing unit 30 between the developing part 34*a* and the developer storage part 34*b* so as to define a partition between the developing part 34*a* and the developer storage part 34*b*. According to an embodiment, the supply member 33*a* or the agitator 35 may be arranged in one side of the partition frame 36, i.e., in the developer storage part 34*b*. According to an embodiment, for example one shown in FIG. 2, the partition frame 36 may be arranged between the supply member 33*a* provided in the developing part 34*a* and the agitator 35 provided in the developer storage part 34*b*.

The partition frame 36 may have formed thereon a developer supply opening 36*a*, through which the developer in the developer storage part 34*b* may be supplied into the developing part 34*a*. A removal member 37 is detachably attached to the partition frame 36 in such a manner covering at least a part of the developer supply opening 36*a* thus preventing the developer in the developer storage part 34*b* from entering the developing part 34*a*. According to an embodiment, the removal member 37 may be arranged to cover and thus close the entire developer supply opening 36*a*.

According to an aspect of the present disclosure, the partition frame 36 may be provided separately from the first frames 340 and 341, and may be installed to the first frames 340 and 341. Providing the partition frame 36 as separate member from the first frames 340 and 341 allows the removal member 37 to be attached to the partition frame 36 prior to installing the partition frame 36 to the first frames 340 and 341, thus allowing a simpler installation of the removal member 37.

Figure 5:
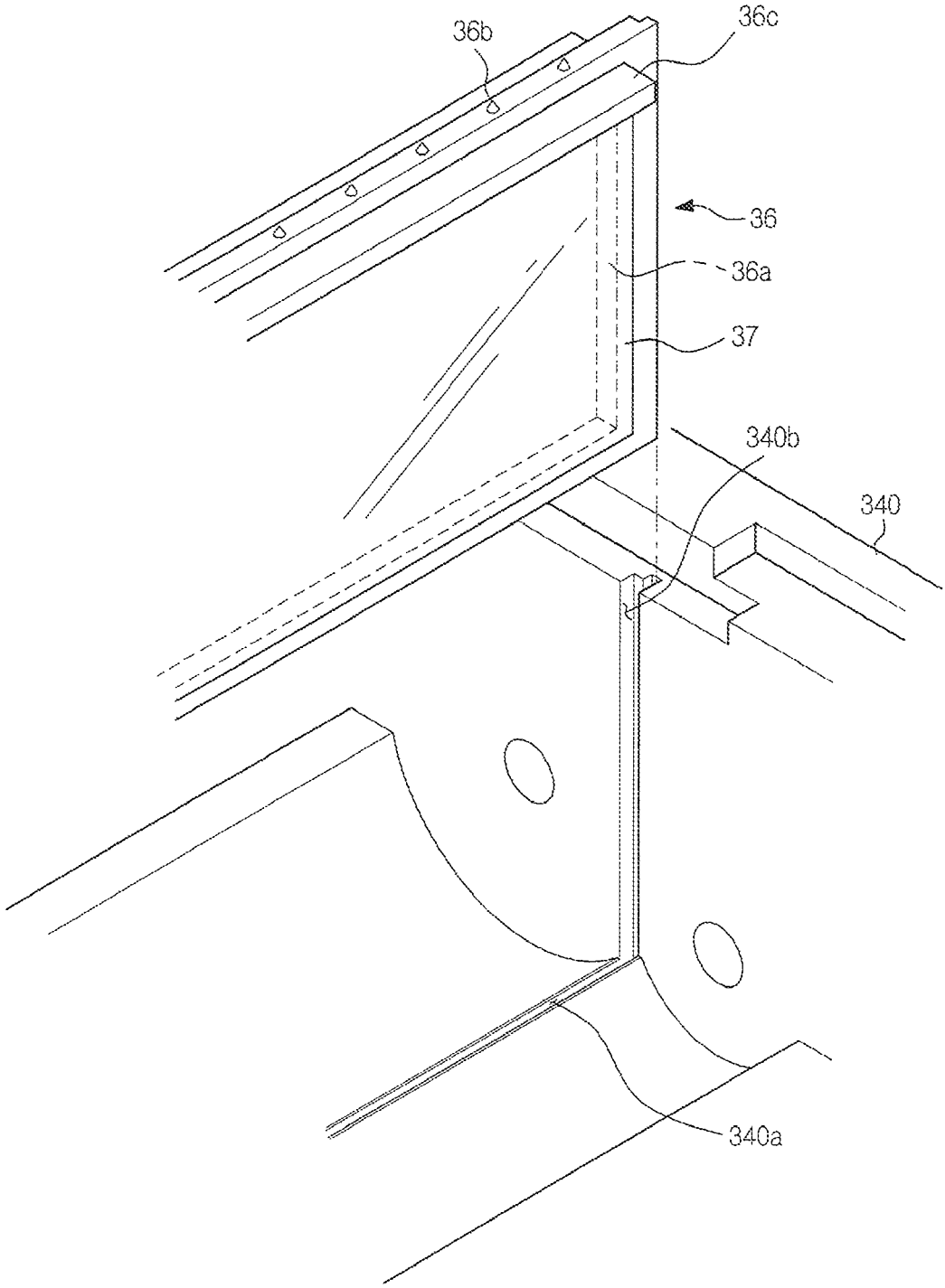
Figure 6:
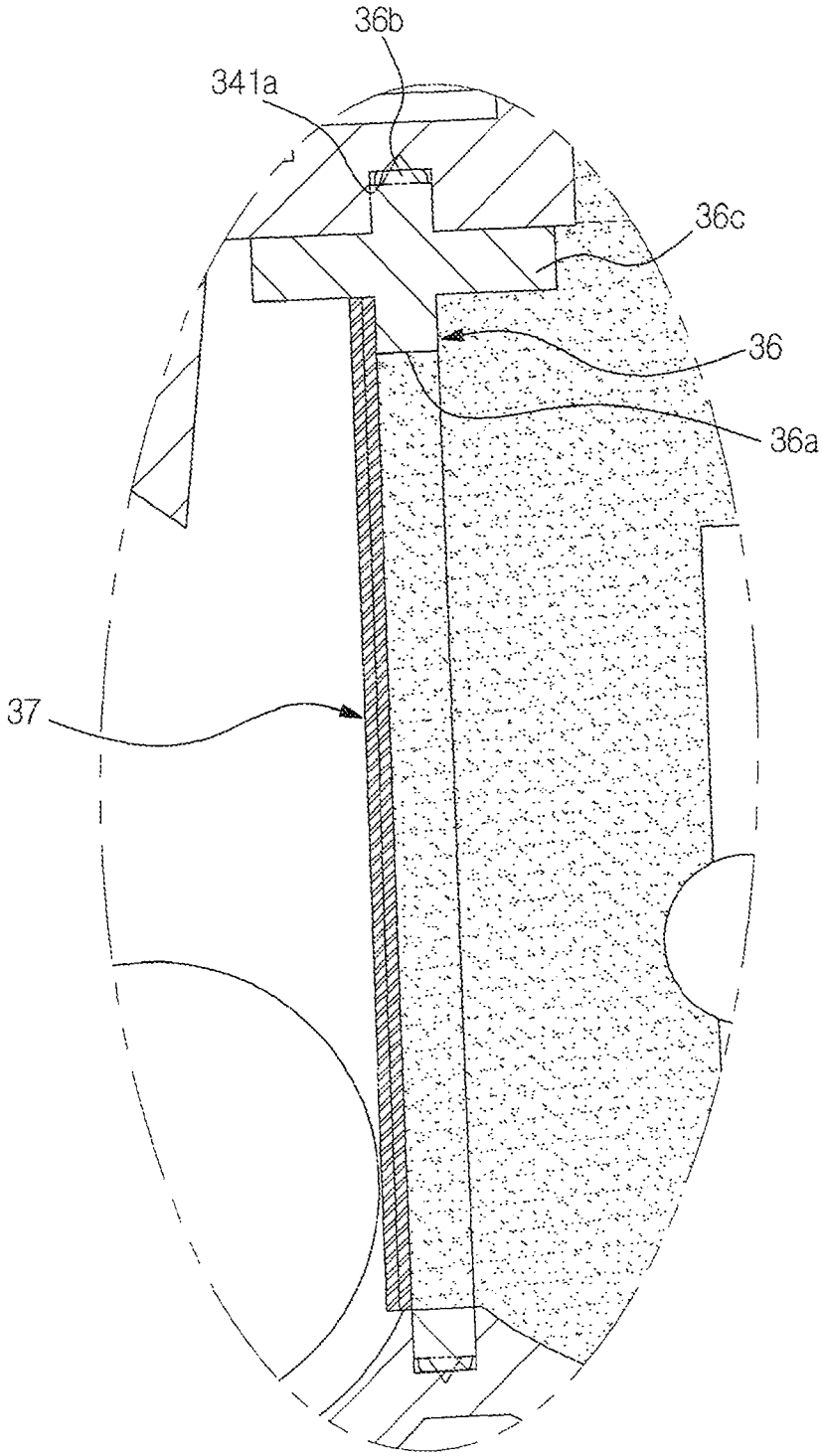
FIG. 6 is a sectional view illustrating an installation configuration of the partition frame of a developing unit according to an embodiment of the present disclosure.

For installation of the partition frame 36, according to an embodiment of the present disclosure, the lower frame 340 has a first supporting groove 340*a* into which a lower end of the partition frame 36 is received and supported, and the upper frame 341 has a second supporting groove 341*a* (see FIG. 6) into which an upper end of the partition frame 36 is received and supported. The first and second supporting grooves 340*a* and 341*a* may be arranged to oppose each other. The partition frame 36 may have a supporting portion 36*c* extending from the upper end thereof. The supporting portion 36*c* may serve to keep the upper end of the partition frame 36 stably supported by a portion of the upper frame 341 adjacent to the second supporting groove 341*a*. The first frames 340 and 341 may further include third supporting grooves 340*b* formed in opposing sides thereof for supporting the side ends of the partition frame 36. According to an embodiment, as shown in FIG. 5, one or both of the side ends of the partition frame 36 may include a stepped surface, the shape of which corresponds to the stepped surface of the associated third supporting grooves 340*b*, thus allowing one or both of the side ends of the partition frame 36 to be stably supported in the third supporting grooves 340*b*.

Accordingly, as the upper and lower ends of the partition frame 36 are received and supported respectively in the second supporting groove 341*a* and first supporting groove 340*a* while both the side ends of the partition frame 36 are received and supported respectively in the third supporting grooves 341*a*, the partition frame 36 may be installed between the lower frame 340 and the upper frame 341.

According to an embodiment, one or both of the upper and lower ends of the partition frame 36 may be formed with one or more coupling protrusions 36*b* to be received into one or more coupling recesses (not shown) correspondingly arranged on respective one or more of the lower frame 340 and upper frame 341. With the use of the coupling protrusions 36*b*, the lower end of the partition frame 36 may be supported in the first supporting groove 340*a* of the lower frame 340 with an improved security, and/or the upper end of the partition frame 36 may be supported to the second supporting groove 341*a* of the upper frame 341 with a greater security.

Accordingly, the partition frame 36 may be fixedly supported between the lower frame 340 and the upper frame 341.

According to an embodiment, the removal member 37 may be folded into two sections, the first one of which sections may be detachably attached around the developer supply opening 36*a* of the partition frame 36 while the second section is arranged to extend parallel to the first section. The distal end of the second section of the removal member 37, as shown in FIG. 3, may be received through an opening or slit 343*a* formed in the connecting bracket 343 to thereby protrude out of the developing unit 30. The removal member 37 may be separated from the partition frame 36, and be removed from the developing unit 30 by applying a force to, e.g., by pulling on, the distal end of the removal member 37 protruding outwardly from the slit 343*a*, Accordingly, since the developer supply opening 36*a* is kept closed by the removal member 37 attached to the partition frame 36 during the transport and/or storage of the developing unit 30, it prevents the developer in the developer storage part 34*b* from leaking into the developing part 34*a*. On the other hand, if the developing unit 30 is installed into the image forming apparatus 100 after the removal member 37 is detached from the partition frame 36 to open the developer supply opening 36*a*, the developer in the developer storage part 34*b* is allowed to move into the developing part 34*a* through the developer supply opening 36*a*, thereby enabling the image forming operations.

Figure 7:
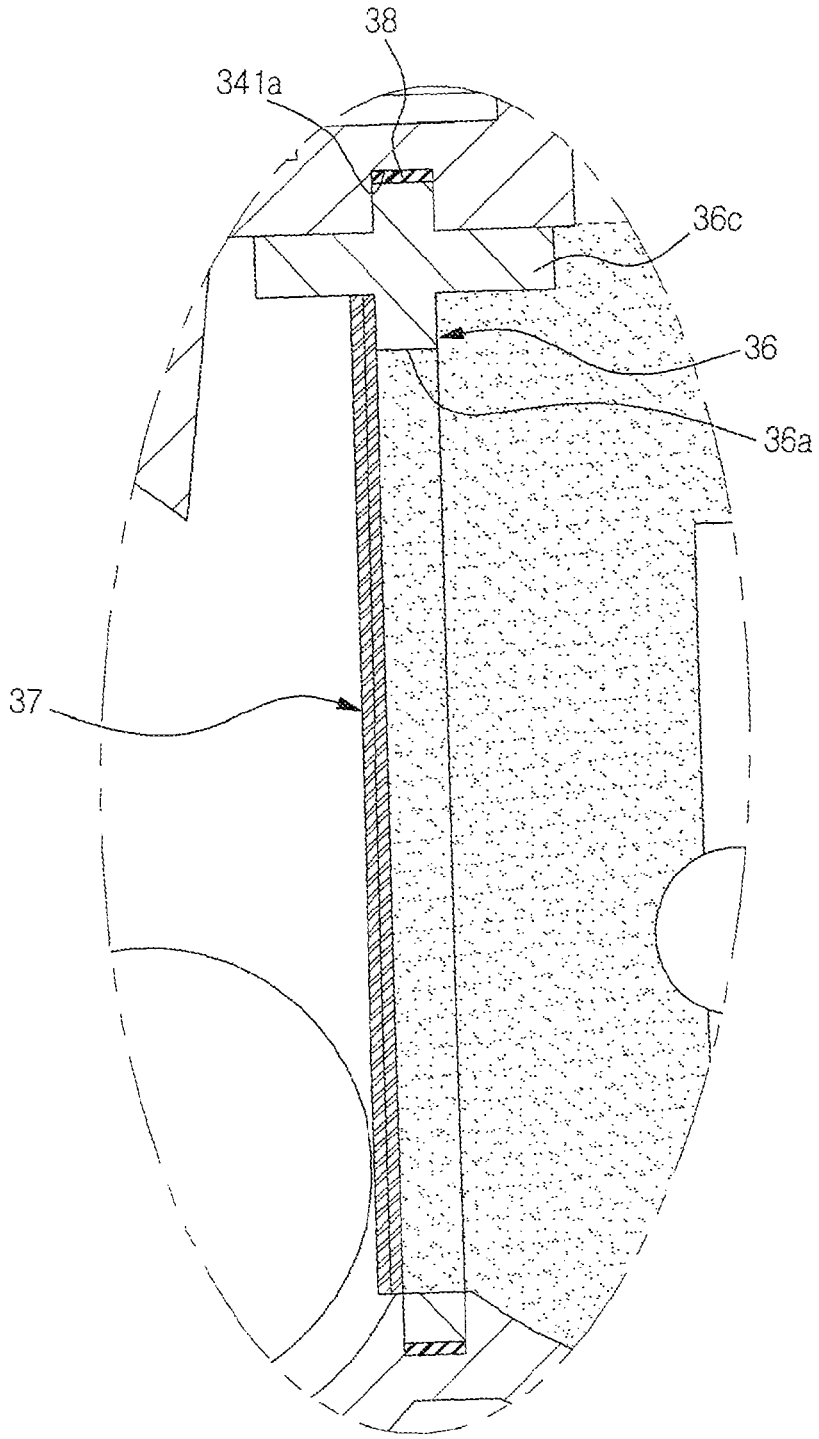
FIG. 7 is a sectional view illustrating an installation configuration of the partition frame of a developing unit according to another embodiment of the present disclosure.

While for purposes of illustration, the partition frame 36 is described as being fixedly coupled to the lower frame 340 and/or the upper frame 341 via the coupling protrusions 36*b* formed at the upper end and/or lower end thereof, the use of such coupling protrusions is described merely as a non-limiting example. That is, other alternative embodiments are possible. For example, as shown in FIG. 7, elastic members 38 made of elastically deformable material may be arranged respectively in the first supporting groove 340*a* and second supporting groove 341*a*, to elastically support the partition frame 36.

The distal end of the removal member 37 protruding out of the connecting bracket 343 may be formed with an integral or separately provided handle (not shown), to allow the user an easier grip on the removal member 37. The use of the handle may enable a more convenient removal of the removal member 37. According to an embodiment, the image forming apparatus 100 may be provided with a sensor (not shown) to sense the presence of the handle. By sensing the presence of the handle, the image forming apparatus 100 may be able to inform a user as to whether or not the removal member 37 is removed.

As is apparent from the above description, in a developing unit and in an image forming apparatus having the same according to one or more embodiments of the present disclosure, a partition frame is provided separately from first frames of a developing unit, and may be coupled to the first frames. With such configuration, a removal member may be attached to the partition frame prior to installing the partition frame to the first frames, resulting in a simpler attachment of the removal member.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A developing unit, comprising:

a developing body configured to develop an image using developer;

a supply member configured to supply the developer to the developing body;

a first frame in which at least one of the developer, developing body, and supply member is arranged;

a partition frame provided separately from the first frame and installed to the first frame between the developing body and an agitator, the partition frame having a developer supply opening through which the developer is supplied to the developing body by the agitator; and a removal member detachably attached to the partition frame in such a manner to cover at least a part of the developer supply opening;

wherein the first frame includes a lower frame and an upper frame coupled to an upper portion of the lower frame, the lower and upper frames together defining developer storage part;

wherein the partition frame is arranged between the lower frame and the upper frame, wherein the lower frame respectively have a first supporting groove and a second supporting groove positioned to oppose each other, lower and upper ends of the partition frame being respectively received into, and thereby supported by, the first and second supporting grooves, wherein the lower frame has formed in opposing sides thereof third supporting grooves, side ends of the partition frame being received into, and thereby supported by, the third supporting grooves, wherein the partition frame is bonded to the lower frame and to the upper frame, wherein the partition frame includes bonding protrusions for bonding the partition frame to the lower frame and to the upper frame, and wherein each of the side ends of the partition frame includes a stepped surface in contact with a correspondingly shaped stepped surface of respective corresponding one of the third supporting grooves, and further comprising:

a supporting portion extending from the upper end of the partition frame so as to be in contact with, and to thereby be supported by, a portion of the upper frame adjacent the second supporting groove.

2. The developing unit according to claim 1, wherein the partition frame is fixedly coupled to the lower frame and the upper frame.

3. The developing unit according to claim 2, wherein the partition frame includes coupling protrusions received into recesses correspondingly arranged on the lower frame and the upper frame.

4. The developing unit according to claim 1, further comprising:

one or more elastic members made of elastically deformable material arranged in at least one of the first supporting groove and the second supporting groove.

5. The developing unit according to claim 1, further comprising:

a second frame defining a storage volume into which waste developer is to be received; and a connecting bracket configured to couple together the first frame and the second frame, wherein the connecting bracket has a hole providing an access to the removal member for removal of the removal member.

6. An image forming apparatus, comprising:

a main body; and a developing unit received in the main body, the developing unit comprising:

a developing body configured to develop an image using developer;

a supply member configured to supply the developer to the developing body;

a first frame in which at least one of the developer, developing body, and supply member is arranged;

a partition frame provided separately from the first frame and installed to the first frame between the developing body and an agitator, the partition frame having a developer supply opening through which the developer is supplied to the developing body by the agitator; and a removal member detachably attached to the partition frame in such a manner to cover at least a part of the developer supply opening, wherein the first frame includes a lower frame and an upper frame coupled to an upper portion of the lower frame, the lower and upper frames together defining a developer storage part;

wherein the partition frame is arranged between the lower frame and the upper frame, wherein the lower frame and the upper frame respectively have a first supporting groove and a second supporting groove positioned to oppose each other, lower and upper ends of the partition frame being respectively received into, and thereby supported by, the first and second supporting grooves, wherein the lower frame has formed in opposing sides thereof third supporting grooves, side ends of the partition frame being received into, and therby supported by, the third supporting grooves, wherein the partition frame is bonded to the lower frame and to the upper frame, wherein the partition frame includes bonding protrusions for bonding the partition frame to the lower frame and to the upper frame, and wherein each of the side ends of the partition frame includes a stepped surface in contact with a correspondingly shaped stepped surface of respective corresponding one of the third supporting grooves, and further comprising:

a supporting portion extending from the upper end of the partition frame so as to be in contact with, and to thereby be supported by, a portion of the upper frame adjacent the second supporting groove.

7. The image forming apparatus according to claim 6, wherein the developing unit further includes coupling protrusions formed at the partition frame, the coupling protrusions being received into recesses correspondingly arranged on the lower frame and the upper frame.

8. The image forming apparatus according to claim 6, wherein the developing unit further comprises one or more elastic members made of elastically deformable material arranged in at least one of the first supporting groove and the second supporting groove.

9. The image forming apparatus according to claim 6, wherein the developing unit further comprises:

a second frame defining a storage volume into which waste developer is to be received; and a connecting bracket configured to couple together the first frame and the second frame, wherein the connecting bracket has a hole providing an access to the removal member for removal of the removal member.

10. An apparatus to form an image using developer, comprising:

a housing;

a first frame in which at least the developer is arranged;

a partition frame formed as a separate member from the housing, the partition frame having an opening and being arranged in the housing in such a manner allowing the developer to move within the housing through the opening of the partition frame; and a removable sealing member arranged to cover the opening of the partition frame, at least a portion of the removable sealing member being accessible from outside of the housing, wherein the first frame, includes a lower frame and an upper frame coupled to an upper portion of the lower frame, the lower and upper frames together defining a developer storage part;

wherein the partition frame is arranged between the lower frame and the upper frame, wherein the lower frame and the upper frame respectively have a first supporting groove and a second supporting groove positioned to oppose each other, lower and upper ends of the partition frame being respectively received into, and thereby supported by, the first and second supporting grooves, wherein the lower frame has formed in opposing sides thereof third supporting grooves, side ends of the partition frame being received into and thereby supported by, the third supporting grooves, wherein the partition frame is bonded to the lower frame and to the upper frame, wherein the partition frame includes bonding protrusions for bonding the partition frame to the lower frame and to the upper frame, and wherein each of the side ends of the partition frame includes a stepped surface in contact with a correspondingly shaped stepped surface of respective corresponding one of the third supporting grooves, and further comprising:

a supporting portion extending from the upper end of the partition frame so as to be in contact with, and to thereby be supported by, a portion of the upper frame adjacent the second supporting groove.

11. A developing unit, comprising:

a developing body to form an image using developer;

a first frame in which at least the developer is arranged;

a supply member to supply the developer to the developing body;

a partition frame disposed between the developing body and the supply member, the partition frame having a developer supply opening through which the developer is supplied to the developing body by the supply member; and a removal member detachably attached to the partition frame to cover at least a portion of the developer supply opening, wherein the first frame includes a lower frame and an upper frame coupled to an upper portion of the lower frame, the lower and upper frames together defining a developer storage part;

wherein the partition frame is arranged between the lower frame and the upper frame, wherein the lower frame and the upper frame respectively have a first supporting groove and a second supporting groove positioned to oppose each other, lower and upper ends of the partition frame being respectively received into, and thereby supported by, the first and second supporting grooves, wherein the lower frame has formed in opposing sides thereof third supporting grooves, side ends of the partition frame being received into, and thereby supported by, the third supporting grooves, wherein the partition frame is bonded to the lower frame and to the upper frame, wherein the partition frame includes bonding protrusions for bonding the partition frame to the lower frame and to the upper frame, and wherein each of the side ends of the partition frame includes a stepped surface in contact with a correspondingly shaped stepped surface of respective corresponding one of the third supporting grooves, and further comprising:

a supporting portion extending from the upper end of the partition frame so as to be in contact with, and to thereby be supported by, a portion of the upper frame adjacent the second supporting groove.

12. An image forming apparatus, comprising:

a main body; and a developing unit received in the main body, the developing unit comprising:

a developing body to form an image using developer;

a first frame in which at least the developer is arranged;

a supply member to supply the developer to the developing body;

a partition frame disposed between the developing body and the supply member, the partition frame having a developer supply opening through which the developer is supplied to the developing body by the supply member; and a removal member detachably attached to the partition frame to cover at least a portion of the developer supply opening, wherein the first frame includes a lower frame and an upper frame coupled to an upper portion of the lower frame, the lower and the upper frames defining a developer storage part;

wherein the partition frame is arranged between the lower frame and the upper frame, wherein the lower frame and the upper frame respectively have a first supporting groove and a second supportinq groove positioned to oppose each other, lower and upper ends of the partition frame being respectively received into, and thereby supported by, the first and second supporting grooves, wherein the lower frame has farmed in opposing sides thereof third supporting grooves, side ends of the partition frame being received into, and thereby supported by, the third supporting grooves, wherein the partition frame is bonded to the lower frame and to the upper frame, wherein the partition frame includes bonding protrusions for bonding the partition frame to the lower frame and to the upper frame, and wherein each of the side ends of the partition frame includes a stepped surface in contact with a correspondingly shaped stepped surface of respective corresponding one of the third supporting grooves, and further comprising:

a supporting portion extending from the upper end of the partition frame so as to be in contact with, and to thereby be supported by, a portion of the upper frame adjacent the second supporting groove.

* * * * *